United States Patent [19]

Thomas

[11] Patent Number: 4,938,508

[45] Date of Patent: Jul. 3, 1990

[54] GATE LATCH

[76] Inventor: Peter C. Thomas, 6750 Riverside Blvd., Sacramento, Calif. 95831

[21] Appl. No.: 308,672

[22] Filed: Feb. 10, 1989

[51] Int. Cl.[5] ..... E05C 3/06

[52] U.S. Cl. ..... 292/235; 292/106; 292/207

[58] Field of Search ..... 292/235, 207, 341.17, 292/106, 225, 208, 179, 150, 248

[56] References Cited

U.S. PATENT DOCUMENTS

| | | | |
|---|---|---|---|
| 82,863 | 10/1868 | Munson et al. . | |
| 201,675 | 3/1878 | Hollingsworth | 292/207 |
| 491,793 | 4/1893 | Armstrong . | |
| 1,118,560 | 11/1914 | Lange . | |
| 1,374,053 | 4/1921 | Brawner, Jr. | 292/225 |
| 1,629,379 | 5/1927 | Dudas | 292/235 |
| 2,516,630 | 7/1950 | Hufnagel . | |
| 3,266,831 | 8/1966 | Banse | 292/341.17 |
| 3,325,203 | 6/1967 | Moler | 292/207 |
| 3,433,518 | 3/1969 | Foltz | 292/235 |
| 3,463,529 | 8/1969 | Rubbio et al. | 292/106 |
| 3,591,219 | 7/1971 | Graziosi | 292/207 X |

FOREIGN PATENT DOCUMENTS

| | | | |
|---|---|---|---|
| 1046552 | 1/1979 | Canada | 292/133 |
| 210880 | 2/1927 | Sweden | 292/225 |
| 503038 | 3/1937 | United Kingdom | 292/235 |
| 472042 | 9/1937 | United Kingdom | 292/207 |
| 659498 | 10/1951 | United Kingdom | 292/341.17 |

*Primary Examiner*—Eric K. Nicholson
*Attorney, Agent, or Firm*—Jerry T. Kearns

[57] ABSTRACT

A gate latch for use with a gate mounted for pivotal movement relative to a stationary fence includes a transversely extending latch bar secured to the gate and a latch member pivotally mounted on a mounting plate secured to the fence. In a first embodiment, a safety latch attachment includes an adapter plate configured for partial overlying attachment adjacent the latch mounting plate and having a reciprocal spring biased plunger in alignment with a transverse aperture formed through a latch frame on the mounting plate. When in a latched position, the plunger prevents the pivotal latch member from being unlatched. A pulley guided cable is connected to retract the plunger to allow the gate to be unlatched. In a second embodiment, the safety latch attachment mechanism is provided as an integral unit on a common mounting plate with the pivotal latch member.

5 Claims, 4 Drawing Sheets

GATE LATCH

BACKGROUND OF THE INVENTION

1. Field of the Invention

The present invention relates to latches, and more particularly pertains to a new and improved gate latch for use with a gate mounted for pivotal movement relative to a stationary fence. Conventional forms of gate latches are easily opened, but are susceptible to unintentional opening through the force of wind acting on the gate, or due to forces exerted by small children or animals. The present invention provides a safety latch attachment which may be easily retrofitted to existing gate latches or may be integrally provided therewith, as a novel improved gate latch.

2. Description of the Prior Art

Various types of latches are known in the prior art. A typical example of such a latch is to be found in U.S. Pat. No. 82,863, which issued to E. Munson et al on Oct. 6, 1868. This patent discloses a sash fastener for a window spring which utilizes a spring actuated plunger to secure a window at any selected elevation. U.S. Pat. No. 491,793, which issued to J. Armstrong on Feb. 14, 1893, discloses a latch mechanism which utilizes a spring biased plunger actuating a latch member and including cooperating cam surfaces. U.S. Pat. No. 1,118,560, which issued to W. Lange on Nov. 24, 1914, discloses a door latch mechanism which utilizes a spring biased latch member actuated by tensioning a chain. U.S. Pat. No. 2,516,630, which issued to H. Hufnagel on July 25, 1950, discloses a window latch which utilizes a plunger biased by a coil spring within a hollow cylinder.

While the above mentioned devices are suited for their intended usage, none of these devices disclose a safety latch attachment including an abutment plate having a notched out portion for alignment with the mounting plate of an existing gate latch. Additionally, none of the aforesaid devices include a reciprocal plunger guided within a hollow cylinder and actuated by tensioning of a cable supported on an integral pulley unit. Inasmuch as the art is relatively crowded with respect to these various types of latches, it can be appreciated that there is a continuing need for and interest in improvements to such latches, and in this respect, the present invention addresses this need and interest.

SUMMARY OF THE INVENTION

In view of the foregoing disadvantages inherent in the known types of latches now present in the prior art, the present invention provides an improved gate latch. As such, the general purpose of the present invention, which will be described subsequently in greater detail, is to provide a new and improved gate latch which has all the advantages of the prior art latches and none of the disadvantages.

To attain this, representative embodiments of the concepts of the present invention are illustrated in the drawings and make use of a gate latch for use with a gate mounted for pivotal movement relative to a stationary fence which includes a transversely extending latch bar secured to the gate and a latch member pivotally mounted on a mounting plate secured to the fence. In a first embodiment, a safety latch attachment includes an adapter plate configured for partial overlying attachment adjacent the latch mounting plate and having a reciprocal spring biased plunger in alignment with a transverse aperture formed through a latch frame on the mounting plate. When in a latched position, the plunger prevents the pivotal latch member from being unlatched. A pulley guided cable is connected to retract the plunger to allow the gate to be unlatched. In a second embodiment, the safety latch attachment mechanism is provided as an integral unit on a common mounting plate with the pivotal latch member.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved gate latch which has all the advantages of the prior art latches and none of the disadvantages.

It is another object of the present invention to provide a new and improved gate latch which may be easily and efficiently manufactured and marketed.

It is a further object of the present invention to provide a new and improved gate latch which is of a durable and reliable construction.

An even further object of the present invention is to provide a new and improved gate latch which is susceptible of a low cost of manufacture with regard to both materials and labor, and which accordingly is then susceptible of low prices of sale to the consuming public, thereby making such latches economically available to the buying public.

Still yet another object of the present invention is to provide a new and improved gate latch which provides in the apparatuses and methods of the prior art some of the advantages thereof, while simultaneously overcoming some of the disadvantages normally associated therewith.

Still another object of the present invention is to provide a new and improved gate latch safety attachment which may be easily retrofitted to existing gate latches to prevent inadvertent opening of the gate.

Yet another object of the present invention is to provide a new and improved gate latch which utilizes a cable actuated plunger to provide a positive locking mechanism for an existing gate latch.

Even still another object of the present invention is to provide a new and improved gate latch which includes a pair of independent cable actuated latches.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanYing drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
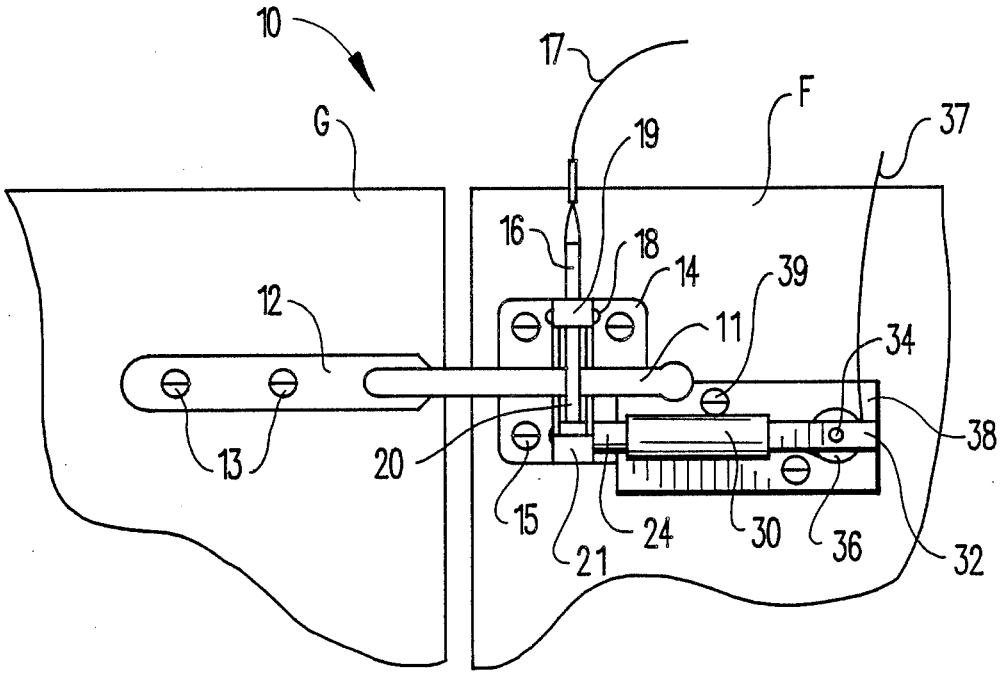
FIG. 1 is a front view illustrating the safety gate latch attachment according to the first embodiment of the invention mounted on portions of a pivotal gate in a stationary fence.

With reference now to the drawings, and in particular to FIG. 1 thereof, a new and improved gate latch embodying the principles and concepts of the present invention and generally designated by the reference numeral 10 will be described.

More specifically, it will be noted that the first embodiment 10 of the invention is designed for use with a gate G mounted for pivotal movement relative to a stationary fence F. A conventional form of existing gate latch utilizes a transverse latch bar 11 secured by a mounting plate 12 to the gate G by a plurality of screws 13. While the bar 11 is usually secured to the relatively movable gate G and the cooperating latching mechanism is usually secured to the stationary fence F, it is to be understood that the orientation of these components may be reversed without departing from the scope of the present invention. A latch frame mounting plate 14 is secured by a plurality of screws 15 on the fence F. A latch member having a first end 16 and a second end portion 20 is pivotally mounted on a pivot pin 18 extending through an upper latch frame portion 19. The upper end portion 16 is connected to a cable 17 which enables remote actuation of the pivotal latch from the opposite side of the fence F. The lower end portion 20 of the pivotal latch member extends over and in partial surrounding relation with the transverse latch bar 11. A lower end of the end portion 20 is secured in a latched position by a transversely reciprocal plunger 24 extending through a transverse aperture in a lower latch frame portion 21. The plunger 24 is biased to the illustrated latched position by a coil spring received within a hollow cylinder 30. The hollow cylinder 30 is secured on the upper surface of an adapter plate 38 which is mounted on the fence F by a plurality of screws 39. A rectangular channel member 32 forms a mounting enclosure for a guide pulley 36 which is mounted for rotation by a pin 34. A cable 37 guided by the pulley 36 extends into the hollow cylinder 30 and is connected to the plunger 24. Thus, by tensioning the cable 37, the plunger 24 may be moved to the right as illustrated in FIG. 1 to an unlatched position, out of the transverse aperture formed through the lower frame portion 21. Upon release of the tension in the cable 37, the plunger 24 is returned to the illustrated latched position by the coil spring within the cylinder 30.

Figure 2:
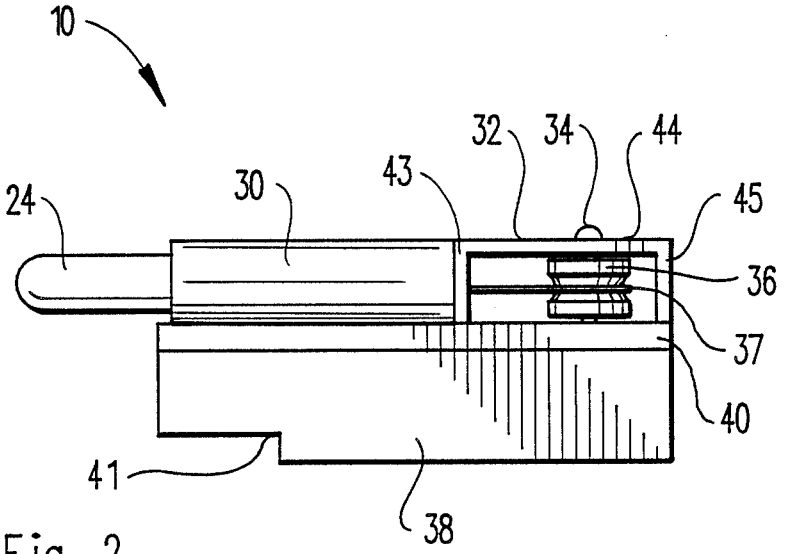
FIG. 2 is a bottom plan view of the safety gate latch attachment of FIG. 1.

As illustrated in FIG. 2, a notched out portion 41 is formed in the bottom surface of the adapter plate 38 for partial overlying relation of the latch frame mounting plate 14 illustrated in FIG. 1. The notched out portion 41 accommodates the thickness of the latch frame mounting plate 14 and serves as a location index surface for the plunger 24 which ensures proper mounting of the plunger 24. A surface plate 40 may be separately formed from the adapter plate 38 and the remaining components of the safety latching mechanism are mounted on this plate. This allows the dimensions of the adapter plate 38 to be adjusted depending upon the dimensions of the existing gate latch. The cable 37 is preferably formed from a corrosion resistant high strength material such as stainless steel and is supported on a low friction nylon pulley 36. The axle pin 34 extends through the transverse wall 44 of the channel member 32 and into the plate 40. The channel member 32 includes first 43 and second 45 parallel side wall surfaces connected by the transverse wall 44. This forms a protective enclosure for the rotational mounting of the pulley 36. The first side wall 43 of the rectangular channel member 32 abuts a second end of the hollow cylinder 30. The cable 37 extends through a passage formed through the side wall 43 in alignment with the cylinder 30 and extends through the coil spring located within the cylinder 30. The reciprocal plunger 24 is reciprocally mounted through a first end of the cylinder 30.

Figure 3:
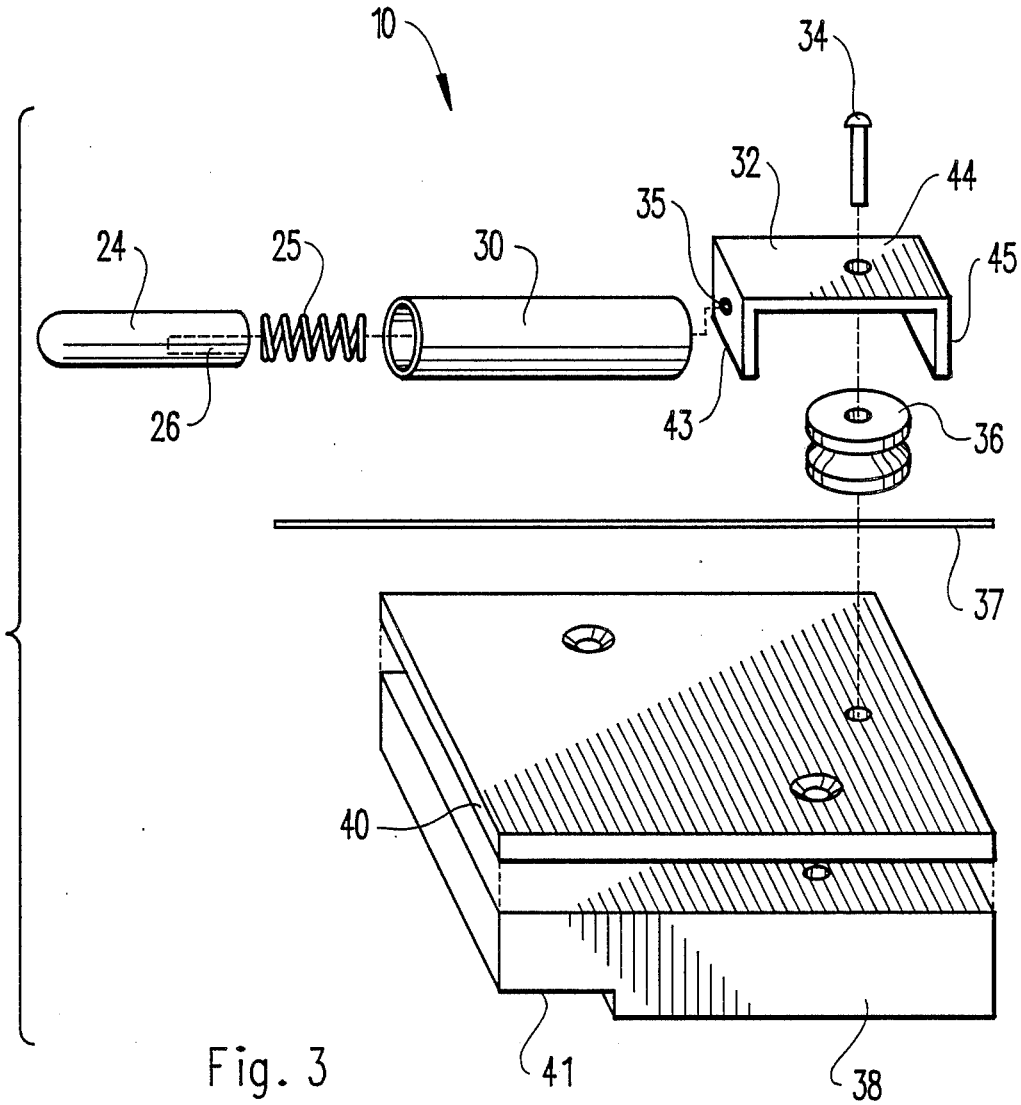
FIG. 3 is an exploded perspective view illustrating the construction of the safety gate latch attachment of FIG. 1.

FIG. 3 illustrates an exploded perspective view of the assembly of the various latch components. A bore 26 may be provided in the inner end face of the plunger 24 for securement of the end portion of the cable 37. The cable end may be secured within the bore 26 through the use of conventional fasteners, by welding or adhesively. The plunger 24 is retained for reciprocal movement within the hollow cylinder 30 by connection with the outer end portion of the spring 25. The inner end portion of the coil spring 25 is preferably secured to the side wall 43 of the channel member 32. The cable 37 extends through a passage 35 formed through the side wall 43 and through the center of the coil spring 25 for insertion into the bore 26. As an alternative for securing the plunger 24 within the cylinder 30, suitable cooperating radial flanges may be formed on the pin or plunger 24 and on the internal cylindrical wall of the cylinder 30, while the spring 25 remains loosely captured therein. This arrangement is illustrated in U.S. Pat. No. 2,516,630, the disclosure of which is hereby incorporated by reference.

Figure 4:
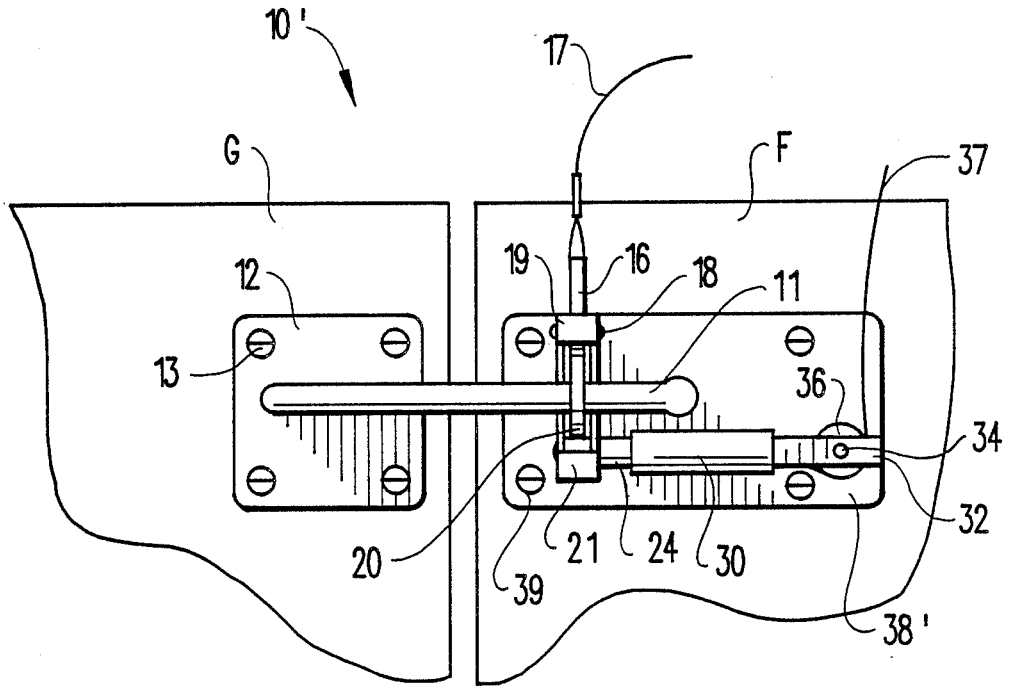
FIG. 4 is a front elevational view illustrating a gate latch according to a second embodiment of the invention, in which the safety latch is provided as an integral unit with the primary gate latch.

FIG. 4 illustrates a slightly modified second embodiment 10' of the invention, in which the latch frame mounting plate 38' provides an integral mounting for the safety latch mechanism 24 and 30 as well as the primary pivotal latch mechanisms 19, 20 and 21. The remaining components are configured as described previously with reference to FIGS. 1 through 3, and similar reference numerals have been utilized.

Figure 5:
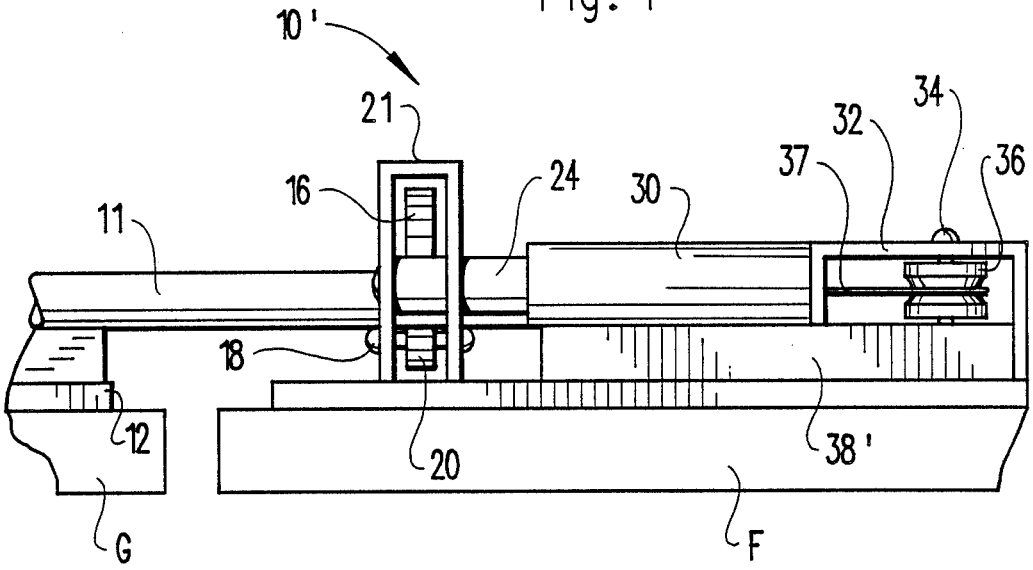
FIG. 5 is a bottom plan view of the gate latch of FIG. 4.

FIG. 5 illustrates a bottom plan view of the latch mechanism 10' of FIG. 4. The pivotal latch member 16 has an arcuate curvature which partially surrounds the transverse latch bar 11. The arcuate end portion 20 of the pivotal latch member is restrained in the illustrated latch position by passage of the plunger 24 through a transverse aperture formed through the lower latch frame portion 21.

Figure 6:
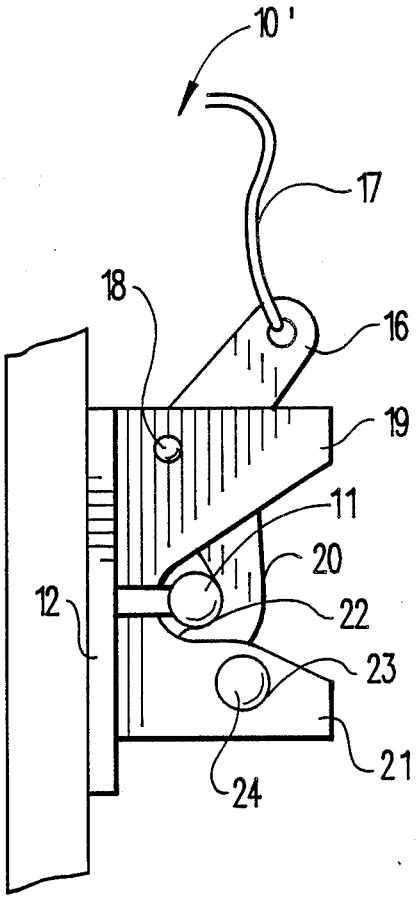
FIG. 6 is a side view illustrating the gate latch of FIG. 4 in a position.

FIG. 6 provides a side view which illustrates the concave or recessed portion 22 of the lower pivotal latch portion 20 surrounding the transverse latch bar 11. The end of the plunger 24 is illustrated received within the transverse aperture 23 formed through the lower latch frame portion 21. The pivot pin 18 extends through the pivotal latch member, between the end portion 16 and 20. Upon retracting the plunger 24 from the aperture 23 by tensioning the cable 37 (FIG. 4), the latch member 16 may be moved to an unlatched position by tensioning the cable 17.

Figure 7:
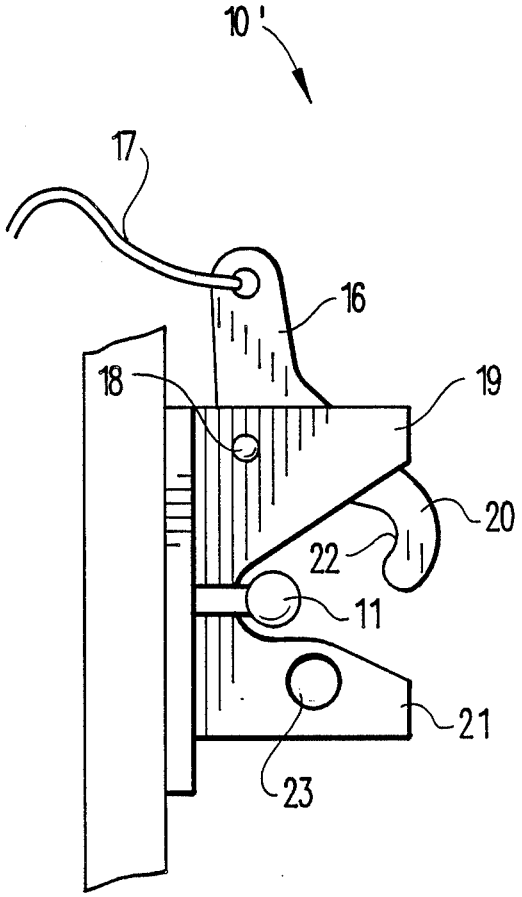
FIG. 7 is a side view similar to FIG. 6, illustrating the gate latch in an unlatched position.

The unlatched position of the latch member 16 is illustrated in FIG. 7. As may now be understood, the present invention provides a secondary latch mechanism which may be utilized with existing gate latches or may be formed as an integral unit to provide primary and secondary cable actuated latch mechanisms. The latch mechanism of the present invention provides an added security factor which prevents the unintentional opening of a gate through forces exerted by wind, children and animals.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. In a gate latch, for use with a gate mounted for pivotal movement relative to a stationary fence, said gate latch having a latch bar adapted for securement on one of said gate or said fence, a pivotal latch member for selective engagement with said latch bar adapted for securement on the other of said gate or said fence, the improvement comprising:

a latch frame;

means mounting said latch member on said frame for pivotal movement between latched and unlatched positions about an axis parallel to said latch bar;

an aperture extending through said latch frame;

a plunger mounted adjacent said latch frame in alignment with said aperture;

a spring biasing said plunger into said aperture for securing said latch member in said closed position;

an adapter plate having a notch formed in a bottom surface thereof for engagement with said latch frame;

a hollow cylinder secured on an upper surface of said adapter plate;

said plunger and said spring received in said cylinder;

a pulley rotatably mounted on said adapter plate adjacent an end of said cylinder; and a cable guided by said pulley and having an end connected to said plunger, whereby said plunger may be moved out of said aperture by tensioning said cable.

2. A safety latch attachment for use with a gate mounted for pivotal movement relative to a stationary fence, a latch bar secured to one of said gate or said fence, a latch frame mounting plate secured to the other of said gate or said fence, a latch frame secured to said latch frame mounting plate, a latch member pivotally mounted on said latch frame for movement between latched and unlatched positions, said latch member engaging said latch bar in said latched position, said safety latch attachment including:

an adapter plate having a planar bottom surface;

a rectangular notched out portion formed in said bottom surface of said adaptor plate dimensioned to receive a portion of said latch frame mounting plate;

means for securing said adaptor plate adjacent said latch frame mounting plate in partial overlying relation therewith;

an aperture formed through said latch frame;

a hollow cylinder having first and second open ends and mounted on an upper surface of said adapter plate in coaxial alignment with said aperture;

a plunger received for reciprocal movement in said first end of said cylinder, said plunger dimensioned for insertion through said aperture;

a rectangular channel member having first and second parallel side walls connected by a transverse wall;

means mounting said channel member on said upper surface of said adapter plate, said first side wall of said channel member in abutment with said second end of said cylinder;

a coil spring received in said cylinder, said spring having a first end secured to said first side wall of said channel member and a second end secured to said plunger, biasing said plunger through said aperture;

means rotatably mounting a pulley within said channel member, between said first and second side walls;

a cable guided by said pulley;

a passage formed through said first side wall of said channel member in alignment with said cylinder; and said cable extending through said passage and said spring and having an end secured to said plunger, whereby said plunger may be moved out of said aperture by tensioning said cable.

3. A gate latch for use with a gate mounted for pivotal movement relative to a stationary fence, comprising:

a latch bar;

means for mounting said latch bar on one of said gate or said fence;

a latch frame mounting plate;

means for mounting said latch frame mounting plate on the other of said gate or said fence;

a latch frame on said latch frame mounting plate in alignment with said latch bar;

said latch frame having a recessed portion dimensioned to receive said latch bar;

a latch member having first and second ends;

means pivotally mounting said latch member on said latch frame, between said first and second ends, for movement between latched and unlatched positions;

said latch member having an arcuate curvature adjacent said second end dimensioned to partially surround said latch bar in said latched position;

an aperture formed through said latch frame;

a hollow cylinder having first and second open ends and mounted on an upper surface of said latch frame mounting plate in coaxial alignment with said aperture;

a plunger received for reciprocal movement in said first end of said cylinder, said plunger dimensioned for insertion through said aperture;

a rectangular channel member having first and second parallel side walls connected by a transverse wall;

means mounting said channel member on said latch frame mounting plate, said first side wall of said channel member in abutment with said second end of said cylinder; and a coil spring received in said cylinder, said spring having a first end secured to said first side wall of said channel member and a second end secured to said plunger, biasing said plunger through said aperture.

4. The gate latch of claim 3, further comprising:

means rotatably mounting a pulley within said channel member, between said first and second side walls;

a cable guided by said pulley;

a passage formed through said first side wall of said channel member in coaxial alignment with said cylinder; and said cable extending through said passage and said spring and having an end secured to said plunger, whereby said plunger may be moved out of said aperture by tensioning said cable.

5. A safety latch attachment for use with a gate mounted for pivotal movement relative to a stationary fence, a latch bar secured to one of said gate or said fence, a latch frame mounting plate secured to the other of said gate or said fence, a latch frame secured to said latch frame mounting plate, a latch member pivotally mounted on said latch frame for movement between latched and unlatched positions, said latch member engaging said latch bar in said latched position, said safety latch attachment including:

an adapter plate having a planar bottom surface;

a rectangular notched out portion formed in said bottom surface of said adaptor plate dimensioned to receive a portion of said latch frame mounting plate;

means for securing said adaptor plate adjacent said latch frame mounting plate in partial overlying relation therewith;

an aperture formed through said latch frame;

a hollow cylinder having first and second open ends and mounted on an upper surface of said adapter plate in coaxial alignment with said aperture;

a plunger received for reciprocal movement in said first end of said cylinder, said plunger dimensioned for insertion through said aperture;

a coil spring received in said cylinder, said spring in contact with said plunger, biasing said plunger through said aperture;

cable guide means secured on said adapter plate, adjacent said second end of said cylinder;

a passage formed through said cable guide means in alignment with said cylinder; and a cable extending through said passage and said spring and having an end secured to said plunger, whereby said plunger may be moved out of said aperture by tensioning said cable.

* * * * *